US008955177B2

(12) United States Patent
Benninger

(10) Patent No.: US 8,955,177 B2
(45) Date of Patent: Feb. 17, 2015

(54) SLEEPING BAG TEMPERATURE RANGE EXTENDER INSERT

(71) Applicant: Gary N. Benninger, West Bloomfield, MI (US)

(72) Inventor: Gary N. Benninger, West Bloomfield, MI (US)

( * ) Notice: Subject to any disclaimer, the term of this patent is extended or adjusted under 35 U.S.C. 154(b) by 80 days.

(21) Appl. No.: 13/900,708

(22) Filed: May 23, 2013

(65) Prior Publication Data

US 2014/0345051 A1 Nov. 27, 2014

(51) Int. Cl.
*A47G 9/08* (2006.01)

(52) U.S. Cl.
CPC ..... *A47G 9/086* (2013.01)
USPC ..... 5/413 R; 5/413 AM; 2/69.5

(58) Field of Classification Search
USPC ..... 5/413 AM, 413 R, 494, 84; 2/69.5
See application file for complete search history.

(56) References Cited

U.S. PATENT DOCUMENTS 4,884,303 A * 12/1989 Scherer ..... 5/413 R
4,894,878 A * 1/1990 Roach ..... 5/413 R
4,910,055 A * 3/1990 Wigutow ..... 5/413 R
5,490,294 A * 2/1996 Kramer ..... 5/413 R
6,175,976 B1 * 1/2001 Cantwell ..... 5/413 R
6,449,787 B1 * 9/2002 Thorne ..... 5/413 R
8,707,479 B2 * 4/2014 Benninger ..... 5/413 R
2004/0123385 A1 * 7/2004 Lamke ..... 5/413 AM
2009/0255059 A1 * 10/2009 Ascroft et al. ..... 5/413 R
2010/0299832 A1 * 12/2010 Alford ..... 5/413 AM
2011/0094004 A1 * 4/2011 Li ..... 2/69

* cited by examiner

*Primary Examiner* — Peter M Cuomo
*Assistant Examiner* — Brittany Wilson
(74) *Attorney, Agent, or Firm* — Dickinson Wright PLLC

(57) ABSTRACT

An insulated sleeping bag insert constructed such that when used with a sleeping bag provides additional insulation thickness above and to the sides of the user, thereby extending the lower limit of the usable temperature range of the sleeping bag. The insert is fitted with attachment mechanisms that allow it to be attached and retained in position within the interior of the sleeping bag. The insulated sleeping bag insert construction is unique in that, in addition to a layer of uniform insulation over the sleeper's body, additional insulation-containing space fillers are incorporated into the sides of the insert to fill-in around the sleeper for reducing the internal volume of the bag.

20 Claims, 10 Drawing Sheets

SLEEPING BAG TEMPERATURE RANGE EXTENDER INSERT

FIELD

The present disclosure relates generally to sleeping bags and, more particularly, to a sleeping bag assembly including a sleeping bag and a thermally insulated insert installed within the sleeping bag for reducing the internal volume of the sleeping bag to extend the lower limit of the sleeping bag's usable temperature range.

BACKGROUND

This section provides background information related to the present disclosure which is not necessarily prior art.

Sleeping bags come in several different physical configurations including, but not limited to, rectangular, semi-rectangular and mummy. In addition, some sleeping bags may incorporate an integral hood. Typically, sleeping bags have one or more closure devices, such as zippers, to provide access to an entrance aperture and which can be located on the sides, ends or top to permit use of the sleeping bag.

Sleeping bags typically include first and second opposed halves defining a sleeping compartment therebetween and which are connected in such a way to define the entrance aperture at an entrance side or end of the sleeping bag. Each half of the sleeping bag includes an outer shell layer and an inner shell layer with an insulating material disposed and retained between these two layers. Insulation thickness depends on the coefficient of thermal conductivity of the insulation material and the minimum ambient air temperature that is expected to be encountered by the user. However, regardless of the type of insulating material and its coefficient of thermal conductivity, colder ambient air temperatures require that a greater thickness of insulation be used to keep heat loss from the user sufficiently low enough that the user does not become uncomfortable within the sleeping compartment.

In view of the above, most sleeping bags having a "usable" ambient air temperature range within which the user will remain comfortable. However, to facilitate the use of otherwise conventional sleeping bags in colder ambient air temperature conditions below the lower limit of its usable temperature range, a need exists to develop alternatives for reducing heat loss within the sleeping compartment. The present disclosure is directed to addressing the above-noted shortcomings of conventional sleeping bags and to providing a solution for extending the lower limit of the useable temperature range of conventional sleeping bags.

SUMMARY

It is an aspect of the present teachings to provide a thermally insulated, sleeping bag insert that can be secured within a sleeping compartment of a sleeping bag so that the sleeping bag can be used at temperatures lower than that for which it was originally designed.

It is another aspect of the present teachings to provide an ultra cold-weather sleeping bag assembly comprised of a cold-weather sleeping bag and a thermally insulated, sleeping bag insert. The thermally insulated insert is installed within the sleeping compartment of the sleeping bag and functions to extend the lower limit of the usable temperature range of the sleeping bag.

In accordance with these and other aspects, the present disclosure is directed to a sleeping bag insert configured to include a plurality of insulation containing compartments. The sleeping bag insert is generally configured such that there is a layer of insulation over the user's body and, in some cases, the insert may also include longitudinal space fillers located along each side that can function, under the influence of the insulating material, to expand inwardly and fill voids surrounding the user's body. A bottom portion of the sleeping bag insert may be constructed such that additional insulation is added in the foot area in the form of a foot box. A top portion of the insert may be constructed to fit over the shoulders and around the neck of the user so as to subdivide the sleeping compartment into two separate compartments.

Further areas of applicability will become apparent from the description and claims herein. The description and specific examples in the disclosure and summary are intended for purposes of illustration only and are not intended to limit the scope of the present invention.

DRAWINGS

The drawings described herein are for illustrative purposes only of selected exemplary embodiments and are not intended to limit the scope of the present disclosure in any way. Similar or identical elements are given consistent reference numerals throughout the various figures.

Reference now will be made to the accompanying drawings in which.

Figure 7A:
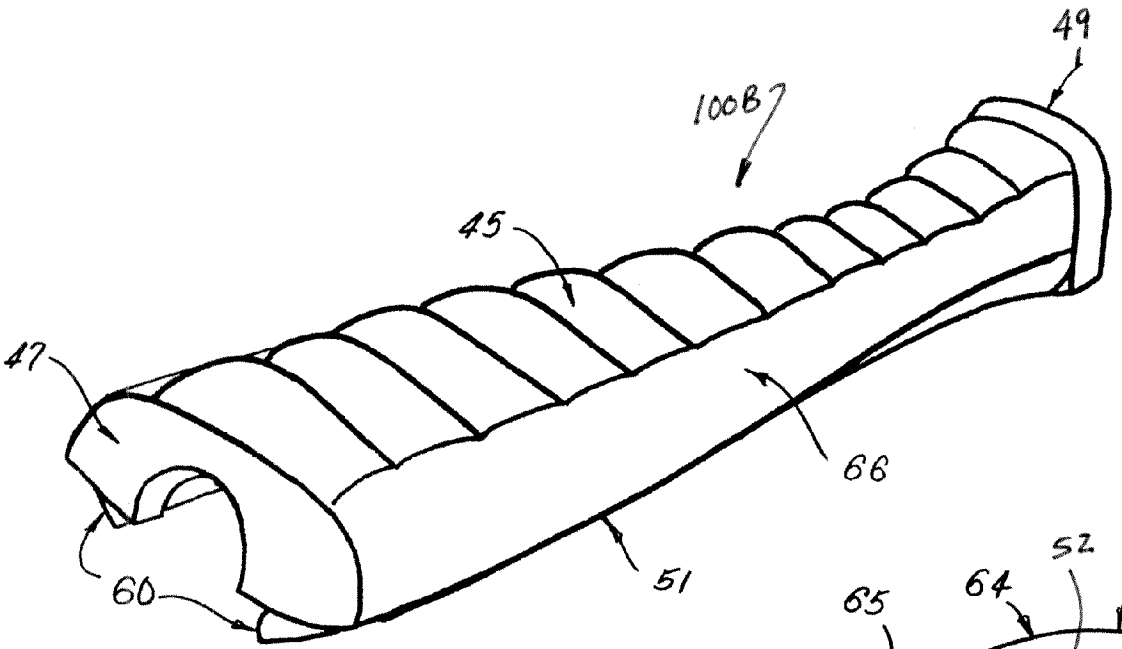
Figure 7B:
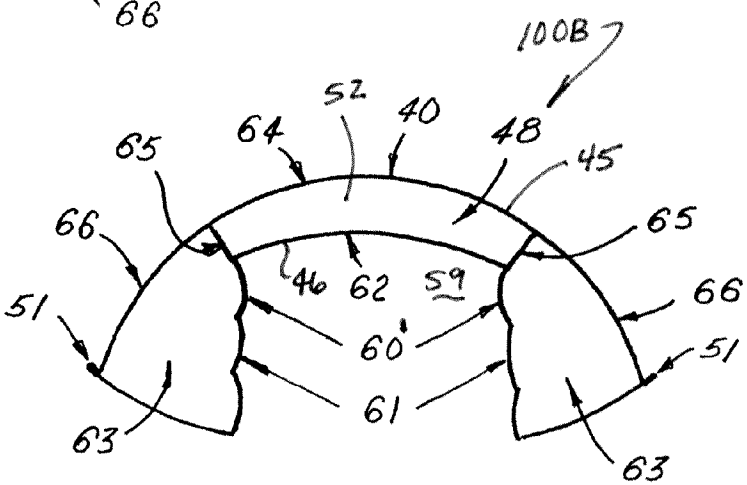
Figure 8A:
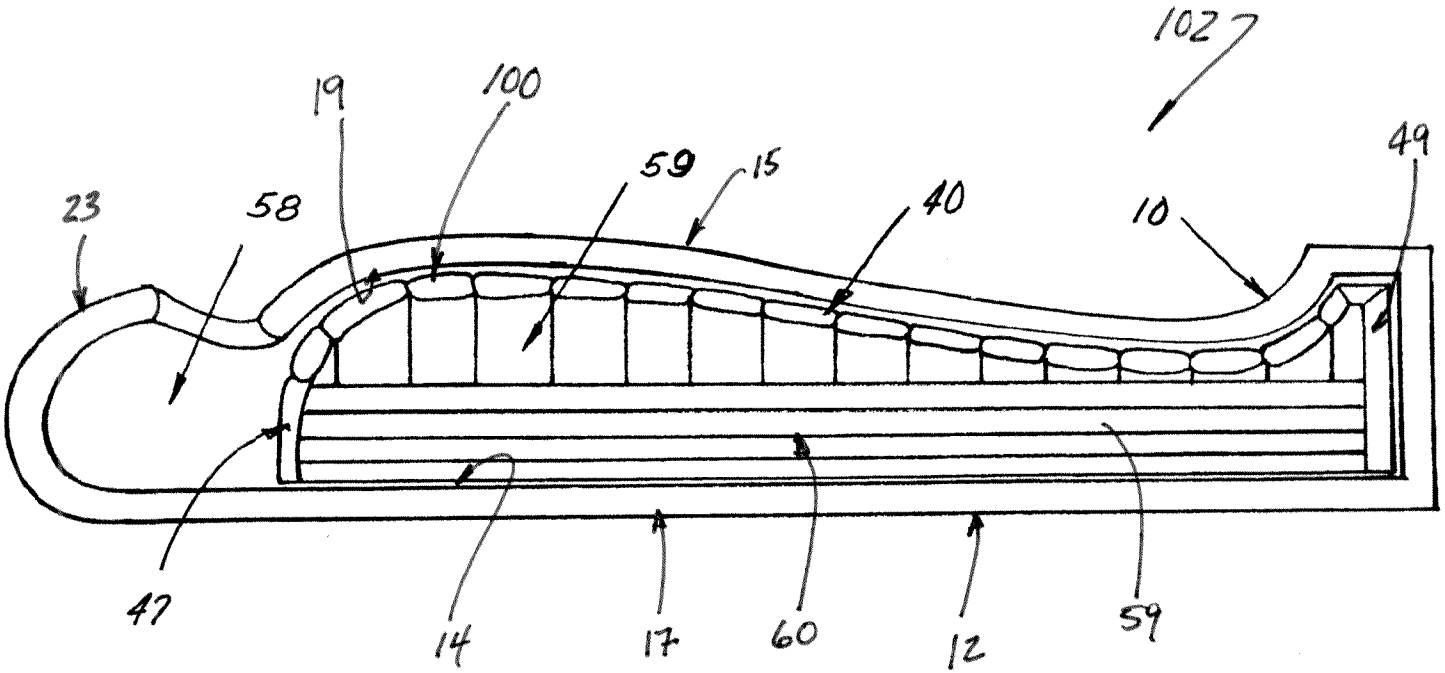
Figure 8B:
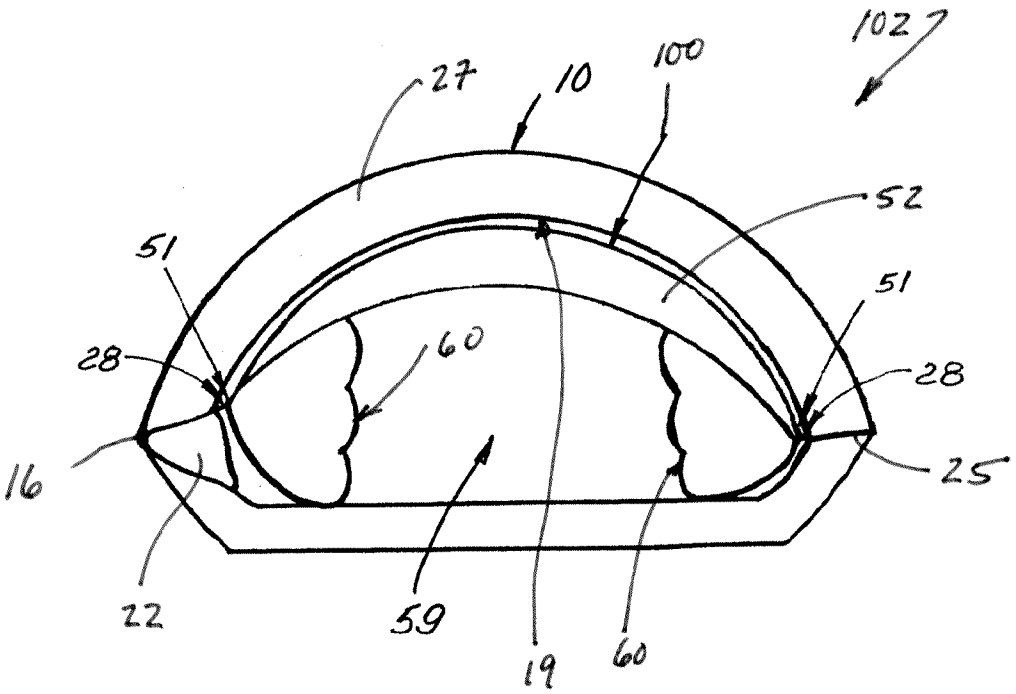
Figure 8C:
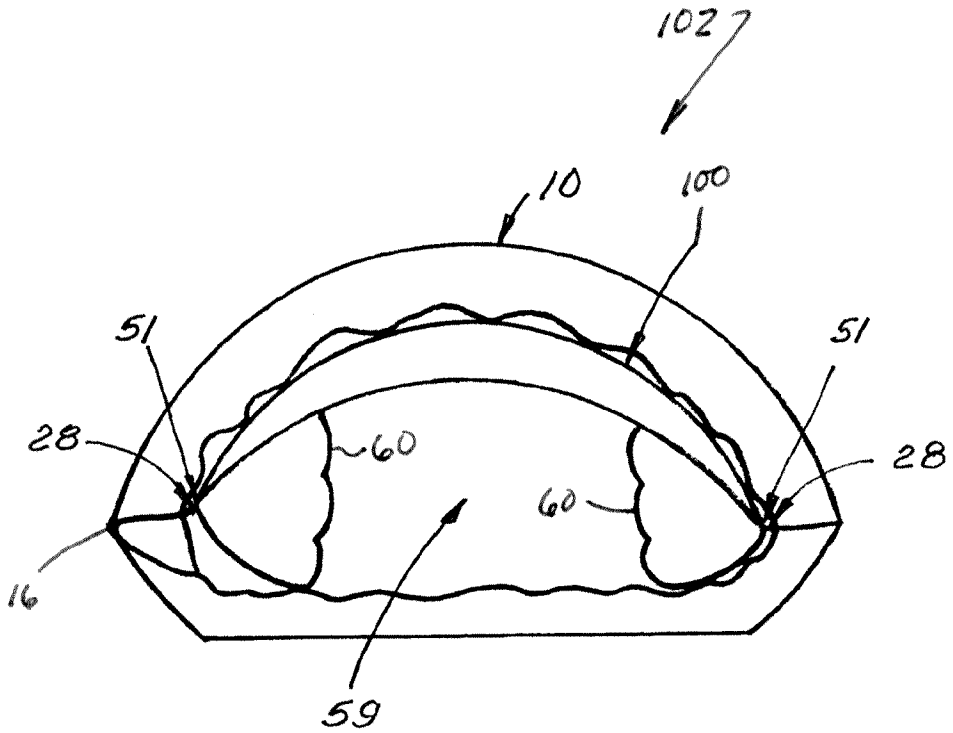

FIGS. 7A and 7B show a perspective view and a sectional view, respectively, of a thermally insulated, sleeping bag insert constructed according to yet another alternative embodiment and incorporating the teachings of the present disclosure; and FIGS. 8A through 8C illustrate longitudinal and transverse cross-sectional views through the sleeping bag assembly with the thermally insulated, sleeping bag insert attached and retained within the sleeping bag according to the present disclosure.

DETAILED DESCRIPTION

The following detailed description of the various exemplary embodiments is provided so that the present disclosure will be thorough and fully convey the scope to those skilled in the art. Numerous specific details are set forth such as examples of specific components, devices and schematic configurations to provide a thorough understanding of each of exemplary embodiments of the present disclosure. However, it will be apparent to those skilled in the art that these specific details need not be employed, that the exemplary embodiments shown may be embodied in many different forms, and that neither should be construed to limit the scope of the present disclosure.

Figure 1:
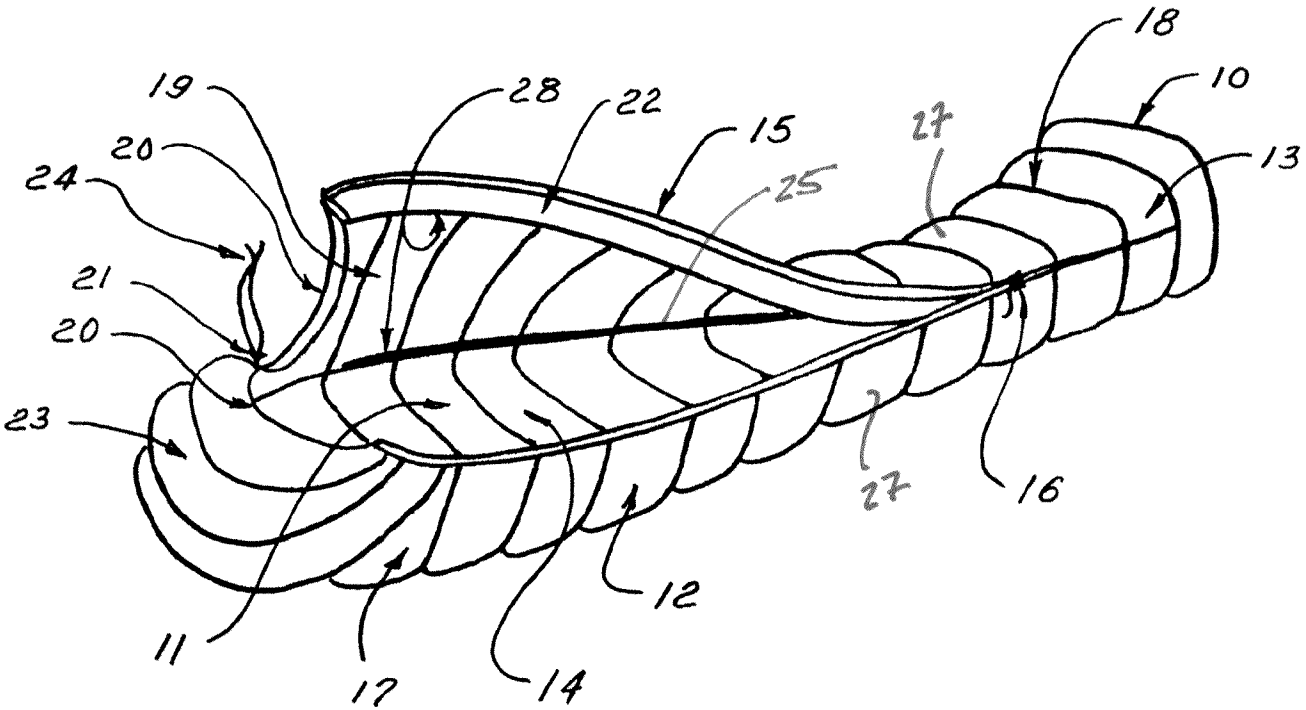
FIG. 1 shows a perspective view of an exemplary sleeping bag adapted for use with a thermally insulated, sleeping bag insert that is constructed in accordance with the present disclosure to define a sleeping bag assembly.

Referring primarily to FIG. 1, a perspective view of an exemplary cold-weather sleeping bag 10 having an integral hood 23 is shown in a partially open position, and which may be constructed to include an entrance end, denoted generally by reference numeral 11. Sleeping bag 10 is generally conventional in construction and, as will be detailed below, is adapted for use with an insulated sleeping bag insert 100 (see FIG. 3) to define an ultra cold-weather sleeping bag assembly 102 (see FIGS. 8A-8C). Entrance end 11 corresponds to the end of sleeping bag 10 which is intended to receive a user's head and upper body while a lower end 13 corresponds to the end of sleeping bag 10 intended to receive a user's legs and feet. Sleeping bag 10 is generally shown to include an outer shell 12, an inner shell 14, and a closure device such as, for example, a zipper assembly 16. An insulating material 18 having a low coefficient of thermal conductivity and good compressibility is inserted and retained between outer shell 12 and inner shell 14. Suitable insulating material may include, but are not limited to, water fowl down, polyester, etc. As is conventional, light-weight fabrics, such as nylon and polyester, may be used for the exterior surfaces defined by outer shell 12 and the interior surfaces defined by inner shell 14.

Sleeping bag 10 has a first or upper half 15 and a second or lower half 17 arranged in opposing facing relation so that first half 15 and second half 17 are configured to define a first or primary sleeping compartment 19 therebetween when zipper assembly 16 is closed. First half 15 and second half 17 can be continuous to define a folded longitudinal edge portion or, as shown, they can be interconnected by a longitudinally extending seam or hinge 25. Second half 17 is adapted to rest on the ground, or tent floor, cot, or on an insulating pad laying on the ground, tent floor or cot.

Sleeping bag 10 may further includes a plurality of insulation retention chambers 27. Sleeping bag 10 is shown to include a plurality of circumferentially aligned retention chamber 27 formed in both of first half 15 and second half 17 that are delineated by seams and/or a baffle material. An elongated draft tube 22, also filled with the insulating material, is located behind and in close proximity to zipper assembly 16 so to maintain an insulating thickness along the entire length of zipper assembly 16. A drawstring 24 can be used in conjunction with a pair of draw hems 19 and 20 to adjustably vary a face opening in hood 23 at the top of sleeping bag 10 once zipper assembly 16 has been drawn to its closed position. A drawstring lock 21 is also provided to maintain drawstring 24 in a preferred cinched position. A pair of first insert attachment devices such as, for example, first zipper halves 28 are attached to opposite sides of an inner surface 30 of inner shell 14 of exemplary cold-weather sleeping bag 10 to facilitate the attachment of sleeping bag insert 100. Zipper halves 28 can be installed upon initial fabrication of sleeping bag 10 or, alternatively, may be subsequently attached to portions of sleeping bag 10. As will be appreciated, alternative first attachment methods or arrangements for releaseably attaching sleeping bag insert 100 within sleeping compartment 19 of sleeping bag 10 may be used and can include for example, and without limitation, loop and pile (e.g., Velcro®), snaps and buttons, etc.

Figure 2A:
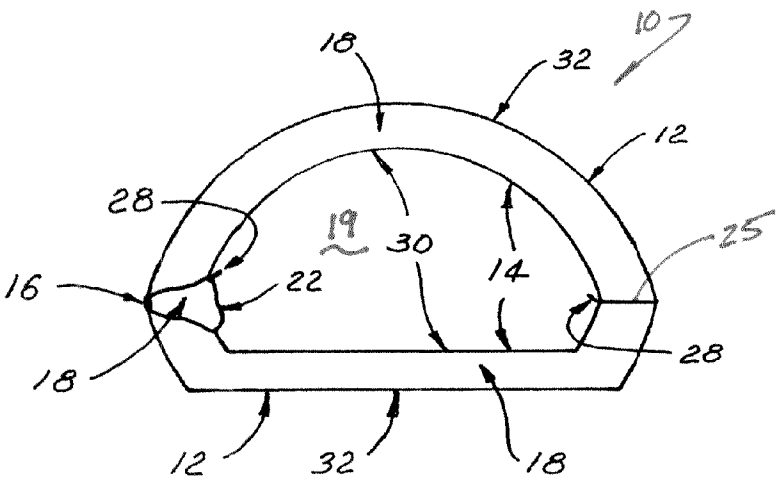
FIGS. 2A and 2B show cross-sectional views of exemplary differential and non-differential cut sleeping bags adapted for use with the thermally insulated, sleeping bag insert of the present disclosure.

FIG. 2A shows the cross-section of an exemplary cold weather, side-zippered sleeping bag 10 fabricated using a "differential" cut construction wherein the circumference of inner surface 30 of inner shell 14 is less than that of an outer surface 32 of outer shell 12 along the full length of sleeping bag 10. Draft tube 22 is shown located behind zipper assembly 16 within sleeping compartment 19. As noted, insulating material 18 having a low coefficient of thermal conductivity and good compressibility is inserted and retained between outer shell 12 and inner shell 14 within retention chambers 27 as well as within draft tube 22. The pair of first zipper halves 28 are shown mounted to opposite sides of inner shell 14 within the interior of exemplary cold-weather sleeping bag 10 to facilitate the attachment of insulated sleeping bag insert 100.

Figure 2B:
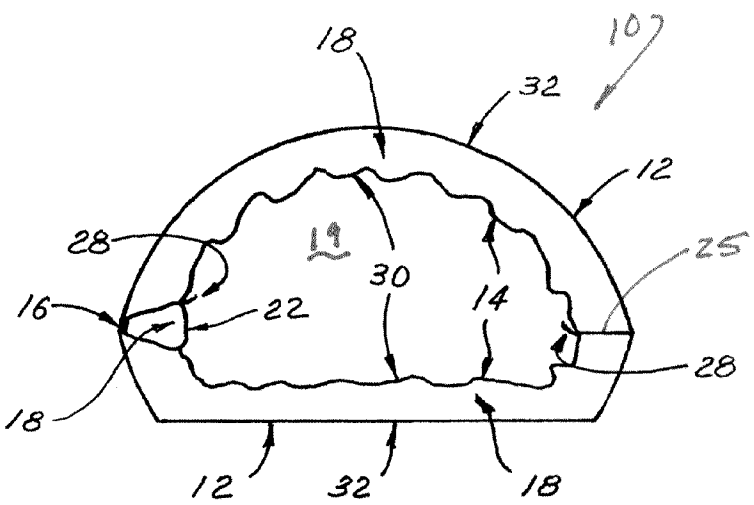

FIG. 2B shows the cross-section of an exemplary cold weather, side-zippered sleeping bag 10 fabricated using a "non-differential" cut construction wherein the circumference of inner surface 30 of inner shell 14 is approximately equal to that of outer surface 32 of outer shell 12 along the full length of sleeping bag 10. Draft tube 22 is again positioned behind zipper assembly 16. Again, insulating material 18 having a low coefficient of thermal conductivity and good compressibility is inserted and retained between outer shell 12 and inner shell 14 as well as within draft tube 22. The pair of first zipper halves 28 are shown attached to opposite sides of inner surface 30 of inner shell 14 of exemplary cold-weather sleeping bag 10 to facilitate the attachment of insulated sleeping bag insert 100.

Figure 3:
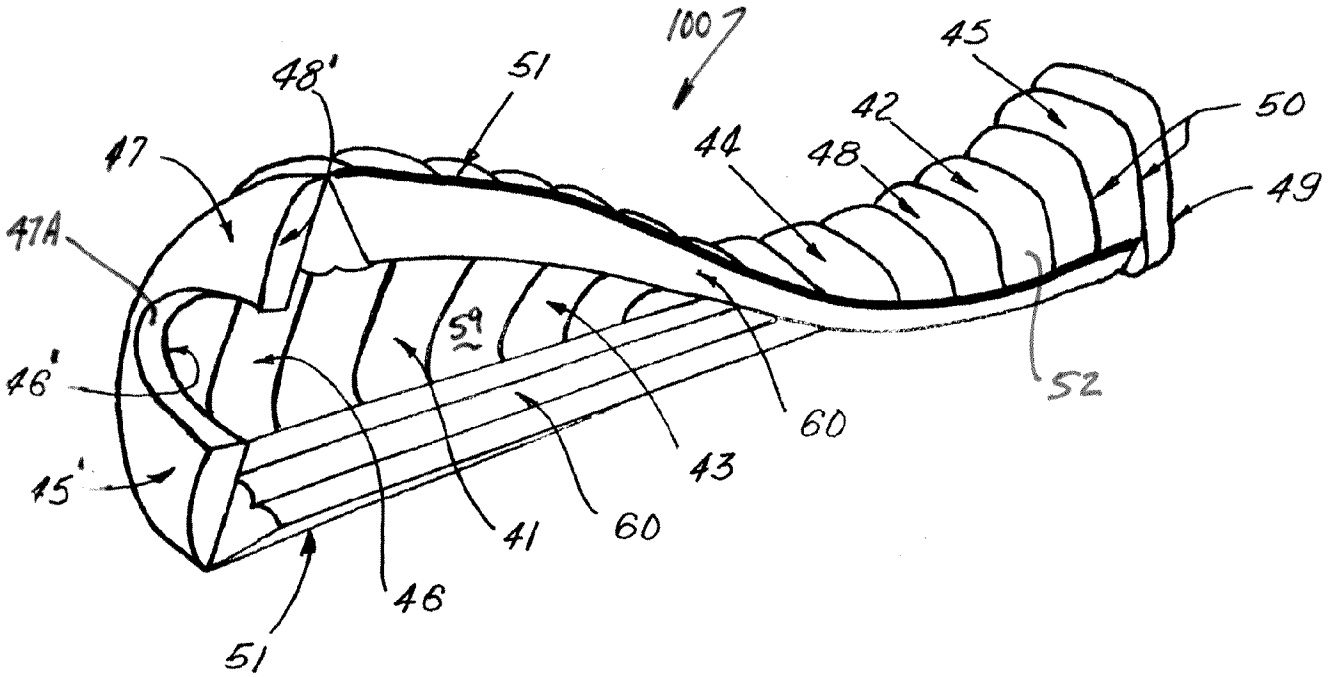
FIG. 3 shows a perspective view of a thermally insulated, sleeping bag insert constructed according to the present teachings and configured with its upper part (the portion covering the upper body of the user) shown in an open or uncovered position while its lower part (the portion covering the legs and feet of the user) shown in a closed or covered position.
Figure 4A:
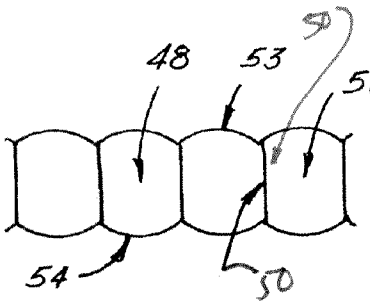
FIGS. 4A through 4E show a series of different insulation retention chamber/tube configurations that may be used with the thermally insulated, sleeping bag inserts of the present disclosure.
Figure 4B:
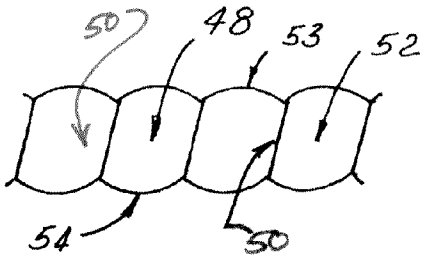
Figure 4C:
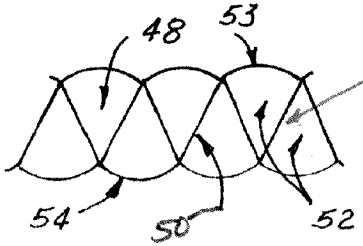
Figure 4D:
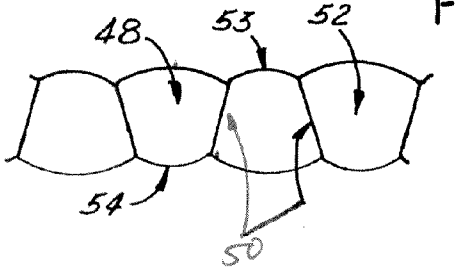
Figure 4E:
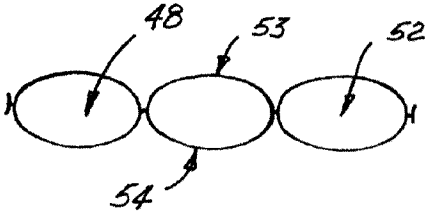

Referring to FIG. 3, a perspective view of a thermally insulated, sleeping bag insert, hereafter referred to as insulated insert 100, constructed according one exemplary embodiment of the present teachings is shown. As stated, the function of insulated insert 100 is to cooperate with sleeping bag 10 so as to extend the lower limit of the variable temperature range of sleeping bag 10. An upper part 41 of insulated insert 100, that is the part of insulated insert 100 adapted to cover the upper body of the user, is shown in an open or uncovered position. A lower part 42 of insulated insert 100, that is the part of the insulated insert 100 that covers the legs and feet of the user, is shown in a closed or covered position. This view has been provided to clearly illustrate both an inner side portion 43 and an outer side portion 44 of insulated insert 100. Insulated insert 100 is generally shown to include an outer shell 45 and an inner shell 46. An insulating material 48 having a low coefficient of thermal conductivity and good compressibility is inserted and retained between outer shell 45 and inner shell 46. A pair of second insert attachment devices such as, for example, second zipper halves 51 are shown attached to insulated insert 100 along the edges of outer shell 45. Second zipper halves 51 are equal in length to the complementary first zipper halves 28 that are mounted to inner surface 30 of inner shell 14 of sleeping bag 10. Engagement of complementary second zipper halves 51 with first zipper halves 28 is adapted to releaseably secure insulated insert 100 in position within sleeping compartment 19 of sleeping bag 10.

An optional yoke 47 may be integrated into the upper end of upper part 41 of insulated insert 100. Yoke 47, like the main body portion of insulated insert 100, includes an outer shell 45' and an inner shell 46' having an insulating material 48' with a low coefficient of thermal conductivity and good compressibility inserted and retained therebetween. Yoke 47 defines a transverse portion having a neck aperture 47A configured to surround the user's neck and shoulder area. An optional foot panel 49 may likewise be integrated into lower portion 42 of insulated insert 100. Foot panel 49 can be configured to be equal in size to the inner foot portion of sleeping compartment 19 within sleeping bag 10. Foot panel 49 is configured to partially close or totally encapsulate lower portion 42 of insulated insert 100 and is constructed to include an outer shell, an inner shell and an insulating material therebetween.

As will be detailed hereinafter with reference to FIG. 4, a plurality of internal baffle structures, generally identified by reference numeral 50, are used to locate and maintain insulating material 48 between outer shell 45 and inner shell 46 within a plurality retention chambers 52 formed in insulated insert 100. Retention chambers 52 can extend longitudinally and/or circumferentially along the length of insulated insert 100. Baffles 50 can be attached to the insert's outer shell 45 and inner shell 46 by suitable means such as, for example, sewing or adhesives for delineating retention chambers 52.

FIGS. 4A through 4E show a series of different insulation retention chambers 52 that may be formed in insulated insert 100. These tubes 52 may run transversely or longitudinally, or any combination thereof, relative to the length of insulated insert 100. Chambers 52 are delineated between an outer shell material 53, an inner shell material 54 and baffles 50 with the exception of the example shown in FIG. 4E where chambers 52 are formed by sewing or otherwise connecting outer shell material 53 directly to inner shell material 54 without the use of baffles 50. As noted, insulation material 48 is inserted into compartments 52. As will be appreciated, chambers 52 formed in insulation insert 100 can be configured differently than chambers 27 in sleeping bag 10 to optimize the positioning and amount of insulation material retained therein.

When use of insulated insert 100 is warranted due to extremely cold ambient air conditions, insert 100 is fitted into sleeping compartment 19 of sleeping bag 10 and retained therein by engaging each of second zipper halves 51 of insulated insert 100 with one of the complementary first zipper halves 28 of sleeping bag 10. As noted earlier, other attachment methods such as loop and pile (e.g., Velcro®), snaps, buttons, etc. may also be used for the purpose of releasably attaching insulated insert 100 to inner shell 14 of sleeping bag 10.

Figures 5A, 5B:
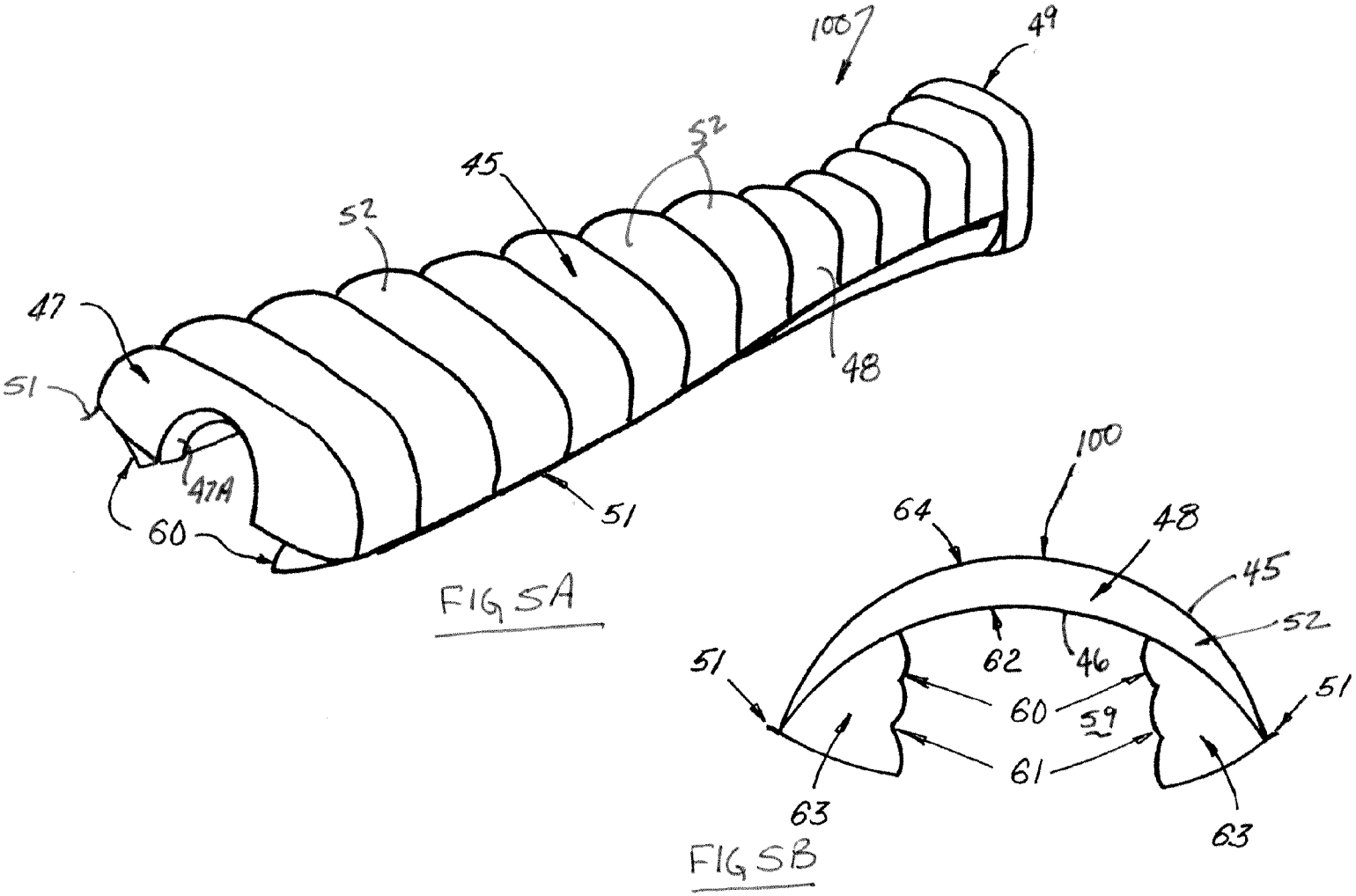
FIGS. 5A and 5B show a perspective view and a sectional view, respectively, of a thermally insulated, sleeping bag insert generally similar to that shown in FIG. 3 and incorporating the teachings of the present disclosure.

In accordance with another aspect of the present disclosure, insulated insert 100 may be constructed to include one or more insulation containing structures or compartments in addition to the insulation retention chambers 52 created between insert outer shell 45 and insert inner shell 46. These additional insulated structures, hereinafter referred to as internal space fillers 60, are integrated into body sleeping compartment 59 of insulated insert 100. Referring primarily to FIGS. 3, 5A and 5B, the features of insulated insert 100 will be better described in greater detail. Specifically, the circumference of an inner surface 62 of inner shell 46 is configured to be less than that of an outer surface 64 of outer shell 45 for the full length of insulated insert 100. As noted, insulation material 48 is retained between outer shell 45 and inner shell 46 within retention chambers 52. Retention chambers 52 are aligned to extend circumferentially. Space fillers 60 are defined or delineated by a spacer shell 61 and a portion of inner surface 62 of inner shell 46. Space fillers 60 extend generally along the entire length of insert 100. In addition, each space filler 60 is filled with an insulation material 63 disposed within the enclosed compartment or compartments therebetween. Insulation material 63 can be the same material or a different material than insulation material 48.

Space fillers 60 may also contain one or more insulation retention chambers using baffling as previously described in FIGS. 4A through 4E. Spacer shell 61 is preferably made of a material common to either outer shell 45 and/or inner shell 46 and which is suitably attached to inner surface 62 along its edges to define an enclosed compartment. The most efficient design would be to carry internal space fillers 60 along the entire length of insulated insert 100. However, it is contemplated that alternative arrangements of one or more space fillers 60 along one or both side wall portions of sleeping bag insert 100 may be utilized. Second zipper halves 51, as used in conjunction with first zipper halves 28 to retain sleeping bag insert 100 in sleeping compartment 19 of sleeping bag 10, are also shown to be outboard of space fillers 60.

Figure 6A:
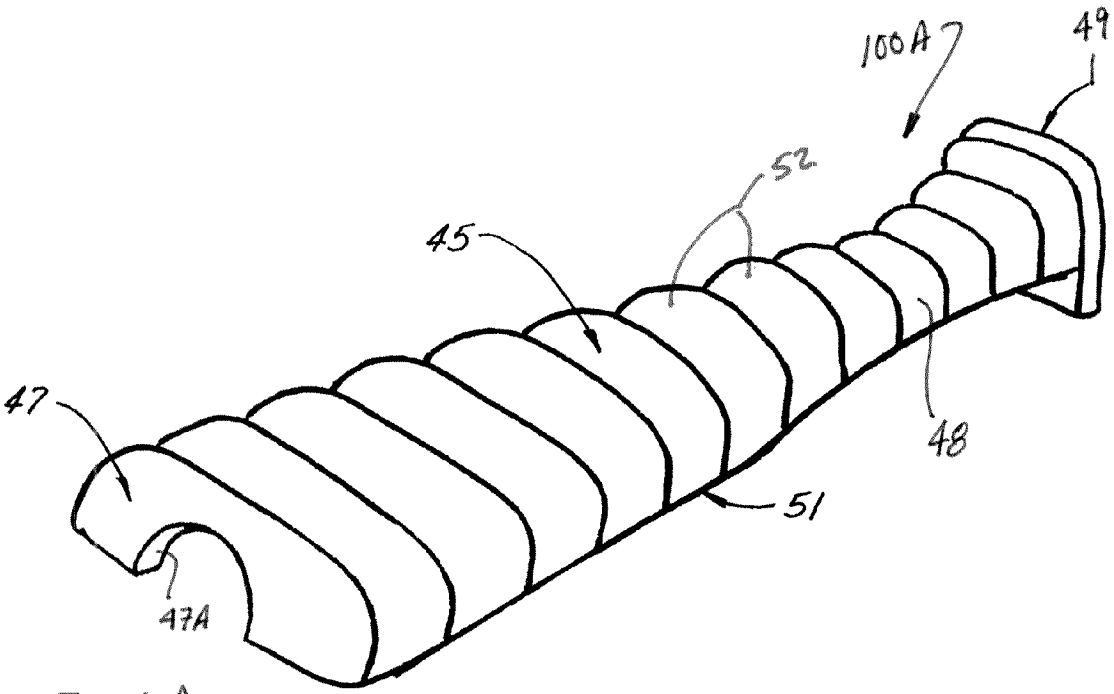
FIGS. 6A and 6B show a perspective view and a sectional view, respectively, of a thermally insulated, sleeping bag insert constructed according to an alternative embodiment and incorporating the teachings of the present disclosure.
Figure 6B:
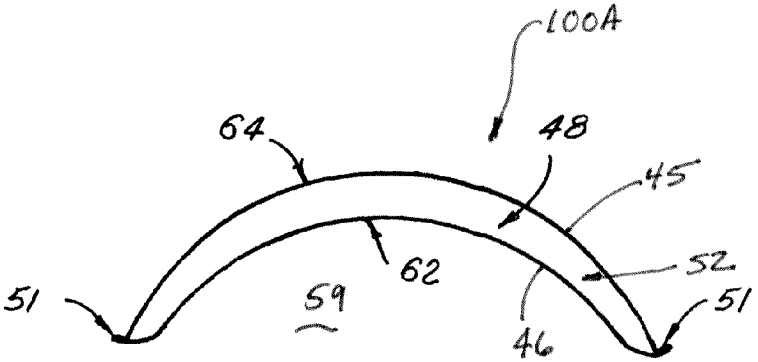

FIGS. 6A and 6B show an insulated sleeping bag insert 100A which is generally similar to insulated sleeping bag insert 100 of FIGS. 3, 5A and 5B and which also incorporates the teachings of the present disclosure. In particular, the circumference of inner surface 62 of inner shell 46 is again shown to be less than or equal to that of outer surface 64 of outer shell 45 along the full length of sleeping bag insert 100A. As noted, insulation material 48 is retained between outer shell 45 and inner shell 46 within retention chambers 52. Insert 100A differs from insert 100 in that space fillers 60 are not used in this exemplary construction. Second zipper halves 51 are again used in conjunction with first zipper haves 28 to retain sleeping bag insert 100A in sleeping compartment 19 of sleeping bag 10.

FIGS. 7A and 7B show a sleeping bag insert 100B constructed in accordance with another alternative embodiment and incorporating the teachings of the present disclosure. In FIGS. 7A and 7B, the circumference of inner surface 62 of inner shell 46 is less than or equal to that of outer surface 64 of outer shell 45 along the full length of sleeping bag insert 100B. As noted, insulation material 48 is retained between outer shell 45 and inner shell 46. Space fillers 60' are now defined or delineated by spacer shell 61, an internal baffle 65 and a portion 66 of outer surface 64 of outer shell 45. Each space filler 60' is filled with insulation material 63 disposed within the enclosed compartment or compartments therebetween. Baffle 65 is preferably made of material similar to baffles 50 or a material common to either outer shell 45 and/or inner shell 46 and which is suitably attached to inner surface 62 and outer surface 64. As noted, space fillers 60' may also contain one or more insulation retention chambers using baffling as described in FIGS. 4A through 4E. Spacer shell 61 is preferably made of a material common to either outer shell 45 and/or inner shell 46 and which is suitably attached to inner surface 62 along its edges to define an enclosed compartment. The most efficient design would be to carry internal space fillers 60' along the entire length of sleeping bag insert 100B. However, it is contemplated that alternative arrangements of one or more space fillers 60' along one or both side wall portions of sleeping bag insert 100B may be utilized. Second zipper halves 51 are again used in conjunction with first zipper halves 28 to retain sleeping bag insert 100B in sleeping compartment 19 of sleeping bag 10.

FIGS. 8A through 8C show longitudinal and transverse cross-sections through sleeping bag assembly 102 comprised of sleeping bag 10 and one of insulated insert 100, 100A, 100B constructed and retained within sleeping bag 10 according to the teachings of the present disclosure. FIG. 8A shows a longitudinal cross-section of sleeping bag 10 with sleeping bag insert 100 having with optional yoke 47 and foot panel 49 installed and retained according to the present disclosure. As noted, first half 15 and second half 17 of sleeping bag 10 are arranged in opposing facing relation so that first half 15 and second half 17 are configured to define a sleeping compartment 19 therebetween when zipper assembly 16 was closed. Accordingly, insertion of sleeping bag insert 100 into sleeping compartment 19 of sleeping bag 10 will cause sleeping compartment 19 to be subdivided into two compartments, a head sleeping compartment 58 and body sleeping compartment 59.

FIG. 8B shows a transverse cross-section of sleeping bag assembly 102 including a differential cut cold weather sleeping bag 10 and an insulated insert 100 attached to sleeping bag 10 using first zipper members 28 in conjunction with second zipper members 51. This cross-sectional view clearly shows the additional insulation thickness gained by use of sleeping bag insert 100 above and to the sides of sleeping compartment 59. In addition, this view also clearly shows that longitudinal space fillers 60 along each side that are cut full so that they can, under the influence of the insulating material, expand inwardly to fill voids surrounding the user's body.

FIG. 8C shows a transverse cross-section of sleeping bag assembly 102 including a non-differential cut cold weather sleeping bag 10 and sleeping bag insert 100 attached and retained therein using first zipper members 28 in conjunction with second zipper members 51. This cross-sectional view clearly shows the additional insulation thickness gained by use of sleeping bag insert 100 above and to the sides of sleeping compartment 59. In addition, this view also clearly shows that the longitudinal space fillers 60 along each side that are cut full so that they can, under the influence of the insulating material, expand inwardly to fill voids surrounding the user's body.

What is claimed is:

1. A sleeping bag assembly comprising:

a sleeping bag having a first half, a second half, a closure device for defining a primary sleeping compartment between the first and second halves when located in a closed position, and a pair of first insert attachment devices located along opposite lateral sides of the sleeping compartment;

an insulated insert configured to be located within the primary sleeping compartment adjacent to the first half of the sleeping bag, the insulated insert having a pair of second insert attachment devices adapted to engage the pair of first insert attachment devices for releaseably securing the insulated insert to the sleeping bag for defining a secondary sleeping compartment configured to receive a user's body between the insulated insert and the second half of the sleeping bag; and at least one space filler extending lengthwise along an edge of the insulated insert and expanding inwardly into the secondary sleeping compartment for filling voids surrounding the user's body when received within the secondary sleeping compartment.

2. The sleeping bag assembly of claim 1 wherein the sleeping bag defines a head opening, and wherein the insulated insert defines a yoke section extending transverse to the at least one space filler and having a neck aperture configured to cooperate with the head opening of the sleeping bag.

3. The sleeping bag assembly of claim 1 wherein the sleeping bag has a usable ambient air temperature range, and wherein the insulated insert functions to extend a lower limit of the useable ambient air temperature range of the sleeping bag.

4. The sleeping bag assembly of claim 1 wherein the insulated insert includes an upper part configured to cover an upper body part of the user and a lower part configured to cover a lower body part of the user.

5. The sleeping bag assembly of claim 4 wherein the upper and lower parts of the insulated insert are interconnected by an outer shell, an inner shell, and an insulating material disposed between the inner and outer shells.

6. The sleeping bag assembly of claim 5 wherein the insulated insert includes a plurality of transversely extending retention chambers are defined between the inner and outer shells for retaining the insulating material therein.

7. The sleeping bag assembly of claim 6 wherein the insulated insert is configured to extend longitudinally along the sleeping bag assembly and cooperate with the second half of the sleeping bag to delineate the secondary sleeping compartment.

8. The sleeping bag assembly of claim 5, wherein an inner circumference of an inner surface of the inner shell is configured to be less than an outer circumference of an outer surface of the outer shell along an entire length of the insulated insert.

9. The sleeping bag assembly of claim 8, wherein the at least one space filler is delineated by a portion of the inner surface of the inner shell and a spacer shell.

10. The sleeping bag assembly of claim 8, wherein the at least one space filler is delineated by a portion of the outer surface of the outer shell, an internal baffle, and a spacer shell.

11. The sleeping bag assembly of claim 1 wherein the first insert attachment devices include a pair of first zipper halves, wherein the second attachment devices include a pair of second zipper halves, and wherein each one of the first zipper halves is releaseably engageable with a corresponding one of the second zipper halves for releaseably securing the insulated insert with the primary sleeping compartment.

12. The sleeping bag assembly of claim 1, wherein the at least one space filler extends along an entire length of the insert.

13. The sleeping bag assembly of claim 1, wherein the at least one space filler includes a pair of space fillers disposed in opposing relationship along opposing edges of the insulated insert.

14. A sleeping bag assembly comprising:

a sleeping bag having a first half and a second half to define a primary sleeping compartment disposed therebetween;

an insulated insert located within the primary sleeping compartment to define a secondary sleeping compartment disposed between the insulated insert and the second half of the sleeping bag for receiving a user's body; and at least one space filler disposed along the insulated insert and extending inwardly into the second sleeping compartment.

15. The sleeping bag assembly of claim 14, wherein the sleeping bag defines a head opening, and wherein the insulated insert having a yoke section extending transverse to the at least one space filler and defining a neck aperture configured to cooperate with the head opening of the sleeping bag.

16. The sleeping bag assembly of claim 14, wherein the insulated insert includes an upper shell having an inner surface and an outer shell having an outer surface, and an inner circumference of the inner surface being less than an outer circumference of the outer surface.

17. The sleeping bag assembly of claim 16, wherein a plurality of transversely extending retention chambers are defined between the inner and outer shells for retaining the insulating material therein.

18. The sleeping bag assembly of claim 14, further comprising:

a pair of first insert attachment devices located along opposite lateral sides of the primary sleeping compartment; and a pair of second insert attachment devices disposed along the insulated insert and adapted to engage the pair of first insert attachment devices for releasably securing the insulated insert to the sleeping bag.

19. The sleeping bag assembly of claim 18, wherein the pair of first insert attachment devices include first zipper halves and the pair of second insert attachment devices include second zipper halves.

20. The sleeping bag assembly of claim 14, wherein the at least one space filler includes a pair of space fillers disposed in opposing relationship along the opposing edges of the insulated insert.

* * * * *